US005441390A

United States Patent [19]

Rapp et al.

[11] Patent Number: 5,441,390

[45] Date of Patent: Aug. 15, 1995

[54] WORM PUMP FOR DELIVERING A METAL MELT

[75] Inventors: Josef Rapp, Traunkirchen; Erich Rauch, Gmunden, both of Austria

[73] Assignee: Ing. Rauch Fertigungstechnik Gesellschaft m.b.H., Gmunden, Austria

[21] Appl. No.: 185,475

[22] Filed: Jan. 24, 1994

[30] Foreign Application Priority Data

Jan. 26, 1993 [AT] Austria ..... 116/93

[51] Int. Cl.[6] ..... F04B 35/04

[52] U.S. Cl. ..... 417/359; 417/363; 417/424.1; 266/239

[58] Field of Search ..... 417/359, 363, 423.15, 417/424.1; 266/236, 239; 222/591, 594

[56] References Cited

U.S. PATENT DOCUMENTS

| | | | |
|---|---|---|---|
| 1,656,281 | 1/1928 | Layne | 417/359 |
| 1,883,266 | 10/1932 | Yoder | 417/424.1 |
| 2,842,208 | 7/1958 | Dukes | 417/363 |
| 3,048,384 | 8/1962 | Sweney et al. | 266/38 |
| 3,115,096 | 12/1963 | Wall | 417/359 |
| 3,776,660 | 12/1973 | Anderson et al. | 415/219 C |

FOREIGN PATENT DOCUMENTS

| | | |
|---|---|---|
| 555861 | 7/1932 | Germany . |
| 62-135695 | 6/1987 | Japan . |
| 879031 | 11/1981 | U.S.S.R. . |

*Primary Examiner*—Richard A. Bertsch
*Assistant Examiner*—Charles G Freay
*Attorney, Agent, or Firm*—Collard & Roe

[57] ABSTRACT

A worm pump for delivering a metal melt comprises a mounting flange, and a tubular pump housing mounted on, and suspended from, the mounting flange, the pump housing defining a lower inlet for receiving the metal melt and an upper outlet for delivering the metal melt. A drive motor is mounted on the mounting flange, the drive motor having a pump shaft extending into the tubular pump housing and comprising a conveyor screw between the inlet and outlet. A guide supports the pump shaft at a lower end thereof, and a universal joint is provided at an upper end of the pump shaft above the upper outlet, the universal joint permitting the pump shaft to pivot and the guide being arranged to support the pump shaft during a pivoting motion.

6 Claims, 1 Drawing Sheet

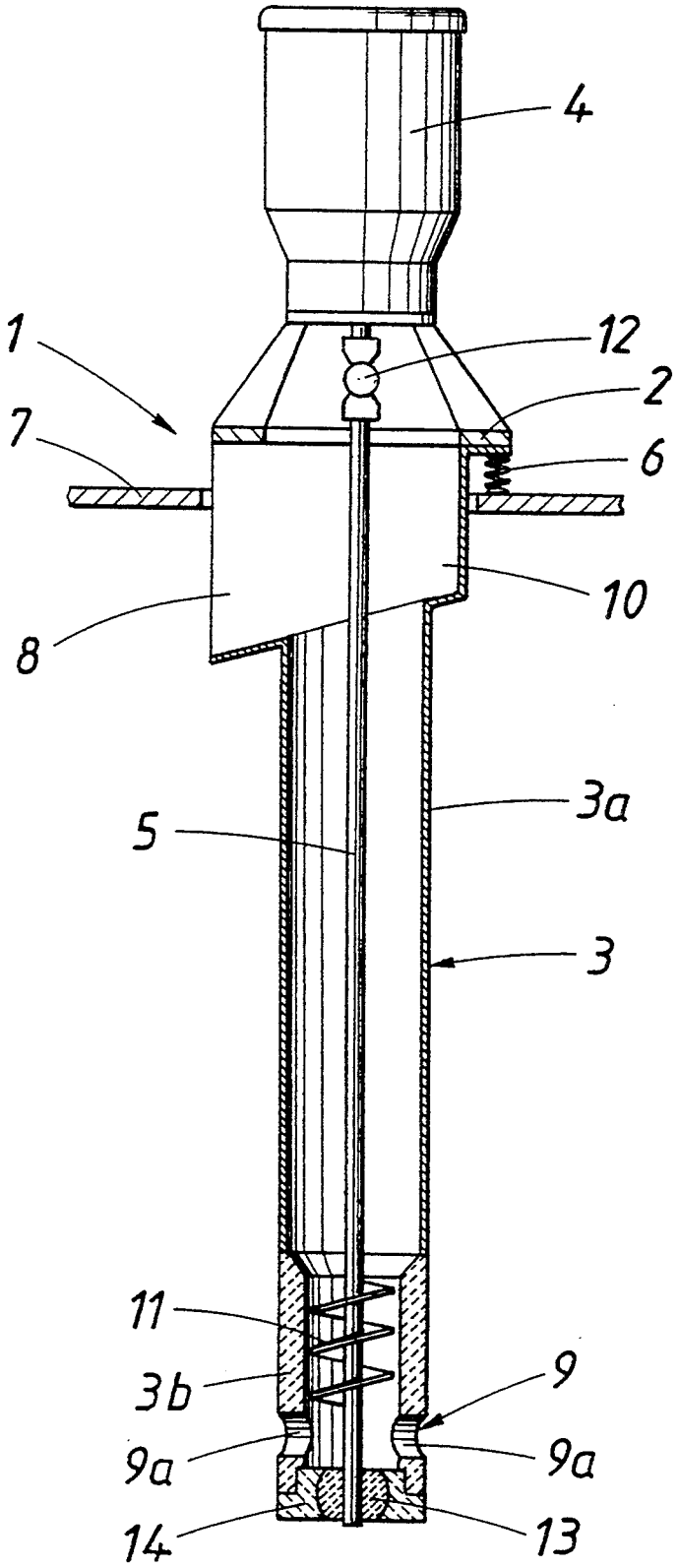
4
1
12
2
7
6
10
8
3a
5
3
11
3b
9
9a
9a
14
13

WORM PUMP FOR DELIVERING A METAL MELT

BACKGROUND OF THE INVENTION

1. Field of the Invention

The present invention relates to a worm pump for delivering a metal melt, which comprises a mounting flange and a tubular pump housing mounted on, and suspended from, the mounting flange. The pump housing defines a lower inlet for receiving the metal melt and an upper outlet for delivering the metal melt. A drive motor is mounted on the mounting flange, the drive motor having a pump shaft extending into the tubular pump housing and comprising a conveyor screw between the inlet and outlet. A guide means is provided for the pump shaft at a lower end thereof.

2. Description of the Prior Art

The possibility of a dependably operating melt delivery, which can be metered, from a container, such as a melt furnace, to a casting machine is a pre-condition for the proper feeding of the melt to the casting machine. In feeding metal melts to a casting machine, a flow of usually less than 100 liters/minute is involved, and the melt delivery is either continuous or intermittent. The delivery systems for delivering metal melts are subjected to considerable stresses, due to the high melt temperatures, danger of clogging when the melt solidifies, the frequent corrosiveness of the melt material, the occurrence of shrinking forces, and the temperature-dependent changes in the shape of the melt. Up to now, no really satisfactory pumps have been available for such a delivery system. The known worm or screw pumps that have been used have rigid pump shafts mounted in fixed rotary bearings. They cannot successfully handle the difficulties due to expansion of the material and they are subject to failure because of freezing of the metal melt. Rotary pumps for emptying galvanizing furnaces can be used only for a short time and for relatively large quantities per time unit. Inductive and conductive piston pumps are complicated and cannot be used for a continuous delivery. Mechanical ladles with their batch-wise delivery and large space requirements do not satisfy the operating conditions of modern casting operations.

SUMMARY OF THE INVENTION

It is the primary object of this invention to overcome the above disadvantages and to provide a work or screw pump of the first-described type which will satisfy the requirements of a metal melt delivery to a casting machine while making full use of the advantage of pumps operating with conveying worms or screws.

The above and other objects are accomplished according to the invention with a worm pump for delivering a metal melt, which comprises a mounting flange and a tubular pump housing mounted on, and suspended from, the mounting flange, the pump housing defining a lower inlet for receiving the metal melt and an upper outlet for delivering the metal melt. A drive motor is mounted on the mounting flange, the drive motor having a pump shaft extending into the tubular pump housing and comprising a conveyor screw between the inlet and outlet. A guide means is provided for the pump shaft at a lower end thereof, and a universal joint at an upper end of the pump shaft above the upper outlet permits the pump shaft to pivot. The guide means is arranged to support the pump shaft during a pivoting motion.

The universal joint and the guide means arranged to support the pump shaft during a pivoting motion enable the pump shaft not only to be rotated by the drive motor but also to effectuate a compensating pivoting motion to absorb temperature-dependent expansions and deformations of the pumped melt. In this way, a trouble-free operation of the pumps is secured in a rational manner. The term "universal joint" used throughout the specification and the claims includes ball joints and any other type of joint enabling the pump shaft to pivot in a direction extending perpendicularly to the axis of the shaft so that the pump shaft portion immersed in the melt is enabled to execute a pendulum motion.

According to one feature of the present invention, the guide means is comprised of a ball-and-socket glide bearing of ceramic material. It may also be comprised of a pendulum roller bearing, preferably of chromium-nickel steel. The guide means enables the pump shaft to rotate, to be axially displaced and to be pivoted in the bearing. It is also possible to use as the guide means the conveyor screw extending with some radial tolerance in a guide part of the tubular pump housing so that the conveyor screw itself serves as the guide enabling the pump shaft to execute the required compensating motion.

Preferably, the tubular pump housing is comprised of an upper tubular part defining the outlet, the upper tubular part consisting of chromium-nickel steel, and a lower tubular part defining the inlet and carrying the guide means, the lower tubular part consisting of a ceramic material. This provides a temperature-resistant, sufficiently rigid pump housing which may be subjected to considerable stresses.

According to another preferred feature of this invention, the outlet is defined by an outlet chamber of larger cross section than the cross section of the tubular housing. Such an enlarged outlet chamber prevents material from clogging up in the region of the outlet and thus avoids freezing of the melt, which endangers the operation of the pump. If the tubular pump housing has a larger inner diameter above the conveyor worm than at the conveyor worm, the flow of the melt within the pump housing above the conveyor worm will be smooth, which again counters any danger of freezing of the melt.

Finally, it is advantageous for the mounting flange to be resiliently yieldingly supported. Such a pendulum support for the pump enables it to yield to the motions of a freezing melt and avoids a change in the pump geometry due to shrinking forces.

BRIEF DESCRIPTION OF THE DRAWING

The above and other objects, advantages and features of this invention will become more apparent from the following detailed description of a now preferred embodiment thereof, taken in conjunction with the accompanying schematic drawing showing the worm pump of the invention in an axial section.

DETAILED DESCRIPTION OF THE PREFERRED EMBODIMENTS

Referring now to the drawing, there is shown worm pump 1 for delivering a metal melt, which comprises mounting flange 2 and tubular pump housing 3 mounted on, and suspended from, the mounting flange. Pump housing 3 defines lower inlet 9 for receiving the metal melt and Upper outlet 8 for delivering the metal melt. Drive motor 4 is mounted on mounting flange 2 and has pump shaft 5 extending into tubular pump housing 3 and comprising conveyor screw 11 between inlet 9 and outlet 8. Worm pump 1 further comprises a resiliently yielding support 6 for mounting flange 2. The indicated resiliently yielding support is a support spring which supports the worm pump on cover 7 of a non-illustrated melt container, such as a melt furnace of the type described and claimed in our copending U.S. patent application Ser. No. 08/185,473, pending, filed simultaneously under the title "Two-Chamber Furnace for Delivering a Melt to a Casting Machine".

The illustrated worm pump has a tubular pump housing comprised of upper tubular part 3*a* defining outlet 8 and consisting of chromium-nickel steel, and lower tubular part 3*b* defining inlet 9 and consisting of a ceramic material. Outlet 8 is defined by an outlet chamber 10 of larger cross section than the cross section of tubular housing 3. The tubular pump housing has a larger inner diameter above conveyor screw 11 than at the conveyor worm, i.e. the inner diameter of upper pump housing part 3*a* is larger than that of lower pump housing part 3*b*. Melt inlet 9 is comprised of symmetrically arranged inlet ports 9*a* in lower pump housing part 3*b*.

The lower end of pump shaft 5 carries conveyor screw 11 within lower pump housing part 3*b* above inlet ports 9*a*, and guide means 13 for pump shaft 5 at a lower end thereof is carried by lower tubular pump housing part 3*b*. Universal joint 12 is built into the upper end of pump shaft 5 above upper outlet 8. The universal joint permits the pump shaft to pivot and guide means 13 is arranged to support the pump shaft during a pivoting motion. The illustrated guide means is comprised of a ball-and-socket glide bearing of ceramic material, the socket 14 holding ball 13.

Worm pump 1 is particularly useful for delivering a metal melt because, on the one hand, it is comprised of materials of sufficient strength and stability to withstand the extreme temperatures of a melt bath and, on the other hand, the compensating motions provided by the universal joint and the cooperating bearing supporting the shaft during such motions enable the pump shaft to yield to temperature-conditioned deformations and expansions of the melt so that the pump will operate trouble-free. The resiliently yielding suspension of the entire pump also compensates for any movement of the melt bath in case of a freezing of the melt. Furthermore, the increasingly larger flow path for the melt from the inlet to the outlet within the tubular pump housing and then at the outlet serves to assure a turbulence-free stream of the melt. This will obviate the danger of freezing of the melt and a subsequent solidification thereof within the pump.

What is claimed is:

1. A worm pump for delivering a metal melt, which comprises
   (a) a mounting flange,
   (b) a tubular pump housing mounted on, and suspended from, the mounting flange, the pump housing defining
      (1) a lower inlet for receiving the metal melt and
      (2) an upper outlet for delivering the metal melt,
   (c) a drive motor mounted on the mounting flange, the drive motor having
      (1) a pump shaft extending into the tubular pump housing and comprising a conveyor screw between the inlet and outlet,
   (d) a guide means for the pump shaft at a lower end thereof, and
   (e) a universal joint at an upper end of the pump shaft above the upper outlet, the universal joint permitting the pump shaft to pivot and the guide means being arranged to support the pump shaft during a pivoting motion.

2. The worm pump of claim 1, wherein the guide means is comprised of a ball-and-socket glide bearing of ceramic material.

3. The worm pump of claim 1, wherein the tubular pump housing is comprised of an upper tubular part defining the outlet, the upper tubular part consisting of chromium-nickel steel, and a lower tubular part defining the inlet and carrying the guide means, the lower tubular part consisting of a ceramic material.

4. The worm pump of claim 1, wherein the outlet is defined by an outlet chamber of larger cross section than the cross section of the tubular housing.

5. The worm pump of claim 1, wherein the tubular pump housing has a larger inner diameter above the conveyor worm than at the conveyor worm.

6. The worm pump of claim 1, further comprising a resiliently yielding support for the mounting flange.

* * * * *